US005588465A

United States Patent [19]

Witowski et al.

[11] Patent Number: 5,588,465

[45] Date of Patent: Dec. 31, 1996

[54] VALVE BLOCK

[75] Inventors: Edgar Witowski, Rutesheim; Guenter Mayer, Murr, both of Germany

[73] Assignee: Robert Bosch GmbH, Stuttgart, Germany

[21] Appl. No.: 416,720

[22] PCT Filed: Feb. 3, 1994

[86] PCT No.: PCT/DE94/00102

§ 371 Date: Apr. 6, 1995

§ 102(e) Date: Apr. 6, 1995

[87] PCT Pub. No.: WO94/19611

PCT Pub. Date: Sep. 1, 1994

[30] Foreign Application Priority Data

Feb. 24, 1993 [DE] Germany ..... 43 05 608.3

[51] Int. Cl.[6] ..... F15B 13/043; F15B 13/08

[52] U.S. Cl. ..... 137/625.64; 137/596.16; 137/884

[58] Field of Search ..... 137/596.16, 625.64, 137/884

[56] References Cited

U.S. PATENT DOCUMENTS 4,726,393 2/1988 Herner ..... 137/625.64 X
4,889,164 12/1989 Hozumi et al. ..... 137/596.16 X

FOREIGN PATENT DOCUMENTS 0554713 1/1993 European Pat. Off. ..... 137/884
5-18472 1/1993 Japan ..... 137/884

*Primary Examiner*—Gerald A. Michalsky
*Attorney, Agent, or Firm*—Michael J. Striker

[57] ABSTRACT

The valve block has a baseplate (1) with longitudinal ducts (11 to 15) for incoming and outgoing air, working-air ducts (16, 17) transversely thereto, connecting ducts (21 to 27) which open out in the connection side (18) in a specific hole pattern, and a well (19) for an electrical installation (20). Attached to the connection side (18) of the baseplate is at least one unit which consists of a directional valve (2) and of two pilot valves (3, 4) triggering this. The pilot valves (3, 4) are arranged in a housing (41) which is fastened by means of an attachment face (42) to an end face (43) of the directional valve (2). A plug base (92) projecting on the underside (29) of the housing (41) engages through a perforation (97) of the baseplate into the well (19) and has projecting contact lugs (93, 94) which are connected to contact terminals (95, 96) on the printed circuit board (20). In order to minimize attachment tolerances, there projects laterally at the lower end of the housing (41) of the pilot valves (3, 4), between the directional valve (2) and the baseplate (1), a plate-shaped extension (101) which has passage bores (102 to 107) corresponding to the hole pattern of the baseplate (1).

8 Claims, 3 Drawing Sheets

VALVE BLOCK

BACKGROUND OF THE INVENTION

The invention relates to a valve block In a valve block of this type known, for example, from U.S. Pat. No. 4,726,393, the pilot valves are screwed in the baseplate from the topside between the directional valves and the installation well and electromagnets are placed on the pilot valves level with the directional valves, the connecting plug arranged on the housing of the electromagnets being coupled to a plug socket inserted in the baseplate above the installation well. In the known valve block, the mounting of the directional valves, the pilot valves and their electromagnets on the baseplate is laborious and has to be carried out carefully.

SUMMARY OF THE INVENTION

Accordingly, it is an object of the present invention to provide a valve block, which avoids the disadvantages of the prior art.

In keeping with these objects and with others which will become apparent hereinafter, one feature of the present invention resides, briefly stated, in a valve block in which a pilot valve and an electromagnet are arranged in a common housing which is arranged to bear with a lateral attachment face against an end face of an associated directional valve, a plate-shaped extension projecting laterally from the attachment face of the housing near an underside of the housing assigned to a connecting plug, so that the directional valve bears against the plate-shaped extension with its connection side, and the baseplate has passage bores congruent with the connecting orifices of the baseplate and of the directional valve.

When the valve block is designed in accordance with the present invention, it has the advantage that the individual directional valves and their pilot valves, together with the electromagnets, can, in each case, be mounted as a unit on the baseplate, the integrated plug connection additionally shortening and simplifying the mounting operation. Moreover, as regards the underside which is formed by the housing of the electromagnets pilot valves and by its one-piece extension and on which the plug projects, only very small tolerances have to be taken into account between the pneumatic passages and the electrical connections, since the connections are made in a single casting mould. The electrical connection can thus be sealed very easily, so that a very high degree of electrical protection is ensured. Even mounting by the customer is therefore possible, without the guaranteed degree of protection having to be restricted. Since the electromagnets of the pilot valves are completely surrounded by the housing, no live parts lead outwards, so that there is no need for a shock-proof plug.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

Exemplary embodiments of the invention are illustrated in the drawing and are described in more detail below.

DESCRIPTION OF THE EXEMPLARY EMBODIMENTS

Figure 1:
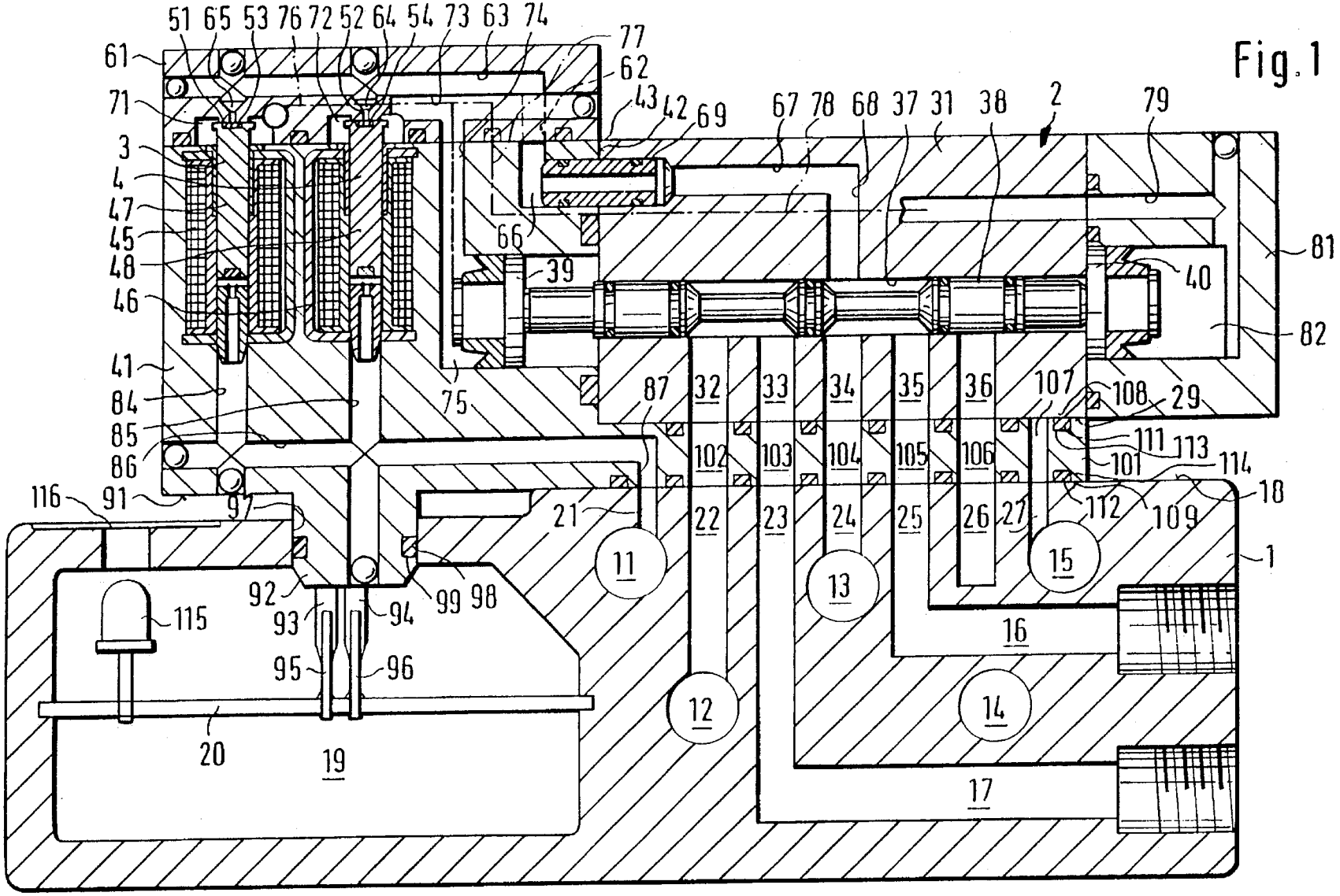
FIG. 1 shows a valve block in cross-section.

The valve block has a baseplate 1 and a plurality of directional valves 2 which are mounted parallel and next to one another on this and which are triggered by electromagnetically actuated pilot valves 3, 4 attached to these. There extend in the baseplate 1, in the longitudinal direction, a plurality of parallel ducts 11 to 15 for incoming and outgoing air and, in each case, two ducts 16, 17 for working air which extend transversely thereto and to which consumers are connected. Connected to the ducts 11 to 17 are blind bores 21 to 27, of which the orifices for supplying the directional valves 2 open out in the upper connection side 18 of the baseplate 1 according to a known hole pattern, for example according to DIN ISO 5599/1. Furthermore, a well 19 having an essentially rectangular cross-section, for accommodating an electrical installation device, for example a printed circuit board 20, extends in the baseplate 1 parallel to the ducts 11 to 15.

The directional valve 2, shown by way of example, for controlling a consumer is a 5/2-way valve with a cuboid housing 31, in the underside 29 of which open out incoming-air, outgoing-air and control bores 32 to 36 adapted to the hole pattern of the base plate 1. Arranged in a passage bore 37 in the housing 31 is a control slide 38 which is actuated by two regulating pistons 39, 40.

For triggering the regulating pistons 39, 40 or the control slide 38, there are the two pilot valves 3, which are each actuated by an electromagnet 45, 46 and are designed as 3/2-way valves and which are arranged in a cuboid housing 41 fastened by means of a plane attachment face 42 to an end face 43 of the directional valve 2 above the well 19 of the baseplate 1. The housing 41 is preferably mould-cast from a plastic and receives the electromagnets 45, 46 together with their armatures 47, 48 positively. The valve seats 51, 52 of the pilot valves 3, 4, with which the sealing faces 53, 54 on the armatures 47, 48 cooperate, are arranged in a cover 61 which is fastened on the topside of the housing 41 of the pilot valves 3, 4. There leads centrally to the valve seats 51, 52 an incoming-air duct which is composed of bores 62 to 65 in the cover 61, of a bore 66 in the housing 41 and of bores 67, 68 in the housing 31 of the directional valve 2 and a fitting sleeve 69 connecting the two housings 31 and 41 and which starts from an incoming-air chamber in the housing 31.

The electromagnets 45, 46, their armatures 47, 48 and the valve seats 51, 52 of the two pilot valves 3, 4 are arranged in the housing 41 preferably in series one behind the other in the extension of the axis of the valve slide 38 of the directional valve 2, both the housings 31 and 41 preferably having an identical thickness and, when assembled, forming a slim unit.

From the control chambers 71, 72 of the pilot valves 3, 4, a duct consisting of a bore 73 in the cover 61 and of a bore 74 in the housing 41 leads to the working space 75 of one regulating piston 39 and a duct consisting of bores 76 to 79 in the cover 61, in the housings 41 and 31 and in an end-face cover 81 leads to the working space 82 of the other regulating piston 40. The working spaces 75 and 82 for the two regulating pistons 39, 40 are preferably arranged in the housing 41 of the pilot valves 3, 4 and in the end-face cover 81. For bleeding the pilot valves 3, 4, a duct consisting of bores 84 to 87 leads to the blind bore 21 in the baseplate 1.

For electrical connection of the electromagnets 45, 46 of the pilot valves 3, 4 to the printed circuit board 20 of the electrical installation device, there projects on the underside 91 of the housing 41 of the pilot valves 3, 4 a plug base 92, in which are arranged three contact lugs 93, 94, which are connected electrically to the electromagnets 45, 46 via connecting leads (not shown) in the housing 41. To make an electrical connection, the contact lugs 93, 94, projecting into the well 19 of the baseplate 1, engage into contact terminals 95, 96 suitably arranged in the printed circuit board 20. To introduce and receive the plug base 92, a perforation 97 aligned with the axis of the hole pattern of the blind bores 21 to 27 is arranged in the baseplate 1 in the region of the well 19. A sealing ring 98 in a circumferential groove 99 of the base 92 protects against the penetration of liquid into the well 19.

In order to ensure an exact congruence of the blind bores 21 to 27 of the hole pattern in the baseplate 1 and the bores 32 to 36 in the housing 31 of the directional valve 2 and of the perforation 97 in the baseplate i with the base 92 of the housing 41 of the pilot valves 3, 4, the housing 41, at its end facing the baseplate 1, has a plate-shaped extension 101 projecting laterally under the housing 41 of the directional valve 2 from its attachment face 42, with two parallel sides, the upper side 108 of which lies in the same plane as the underside 29 of the housing 31 of the directional valve 2. This extension 101 is congruent with the housing 31 of the directional valve 2 and contains passage bores 102 to 107, congruent with the hole pattern of the baseplate 1 and of the directional valve 2, and the connecting bore 87 of the bleed duct of the pilot valves 3, 4. Shaped seals 113, 114 are inserted in grooves 111, 112 of the topside and underside 108, 109 of the plate-shaped extension 101.

In order to check the operation of the electromagnets 45, 46, moreover, pilot lamps or pilot light-emitting diodes 115 visible through windows 116 in the baseplate 1 are arranged on the printed circuit board 20.

Figure 2:
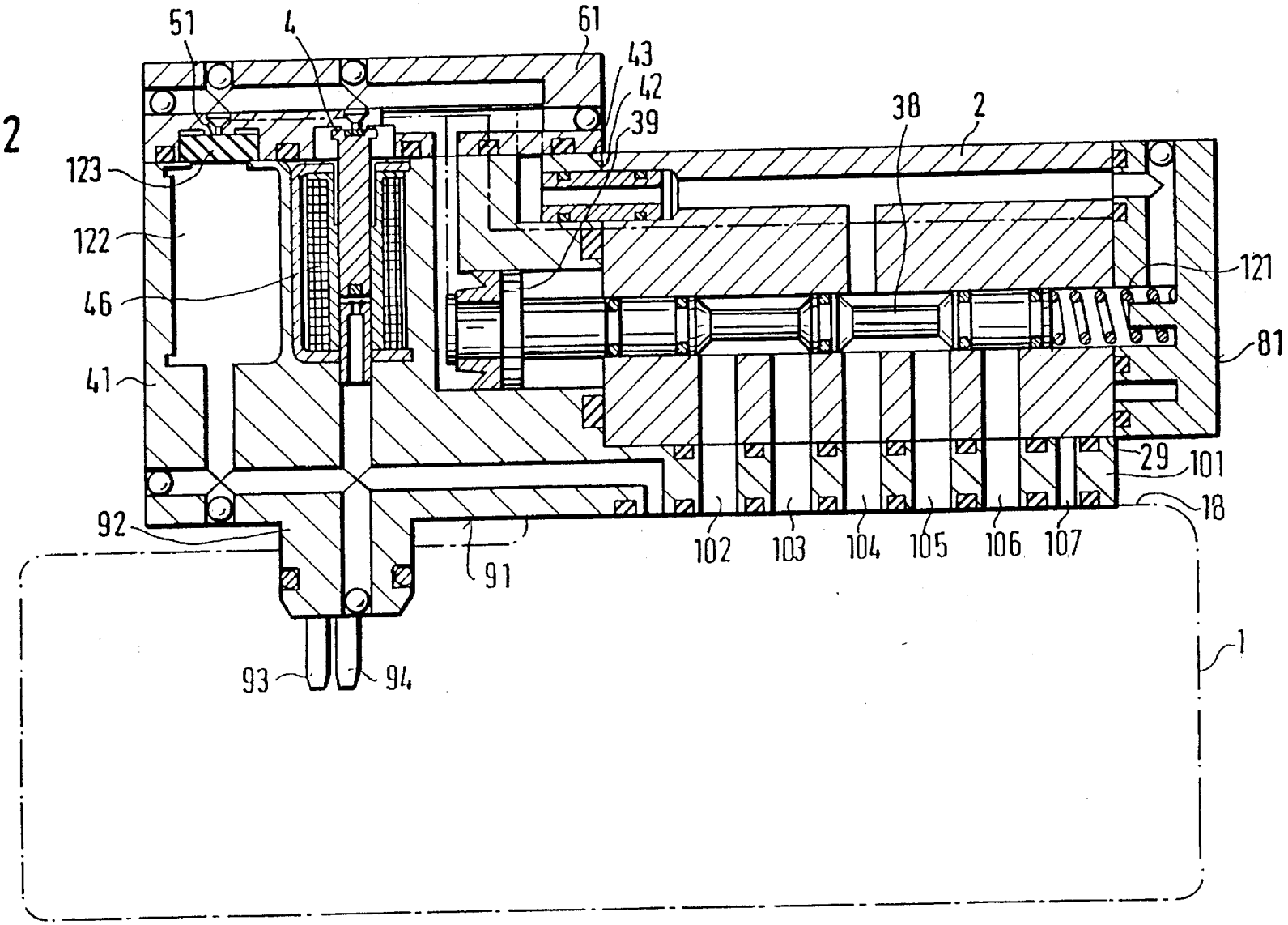
FIG. 2 shows a second exemplary embodiment of a valve block, partially in cross-section.

The alternative exemplary embodiment illustrated in FIG. 2 corresponds essentially to that according to FIG. 1, therefore like parts have the same reference numerals. It differs essentially in that the control slide 38 of the directional valve 2 is actuated only by a single regulating piston 39 in one direction and in the other direction by a compression spring 121 which is supported in the end-face cover 81. In accordance with the arrangement of only the one regulating piston 39, only a single pilot valve 4 is also arranged in the housing 41. The space 122 of the second pilot valve 3 is unoccupied, and the associated valve seat 51 in the cover 61 is sealed off by means of a plate 123. It is also possible, within the scope of the invention, to shorten the housing 41 and its cover 61 by the amount of the free space 112, so that it terminates parallel to the electromagnet 46, the plug base 92 being preserved in full.

The valve block described in the exemplary embodiments according to FIGS. 1 and 2 can be mounted extremely simply and quickly. In the first place, the housing 41 together with the pilot valves 3, 4 is fastened to the attachment end face 43 of the directional valve 2 by fastening means (not shown), such as screws. Valve units thus prepared are then brought successively into congruence with the corresponding portions of the connection side 18 of the baseplate 1, the plug base 92 being aligned with the perforation 97 and the passage bores 102 to 107 being aligned with the orifices of the blind bores 21 to 27 of the hole pattern in the baseplate 1. Each unit is thereupon pressed onto the connection side 18 of the baseplate 1, the plug base 92 being inserted in the perforation 97 to the well 19, and the contact lugs 93, 94 being received by the contact terminals 95, 96 of the printed circuit board 20. Each unit is then fastened to the baseplate 1 likewise by suitable fastening means, such as screws.

Figure 3:
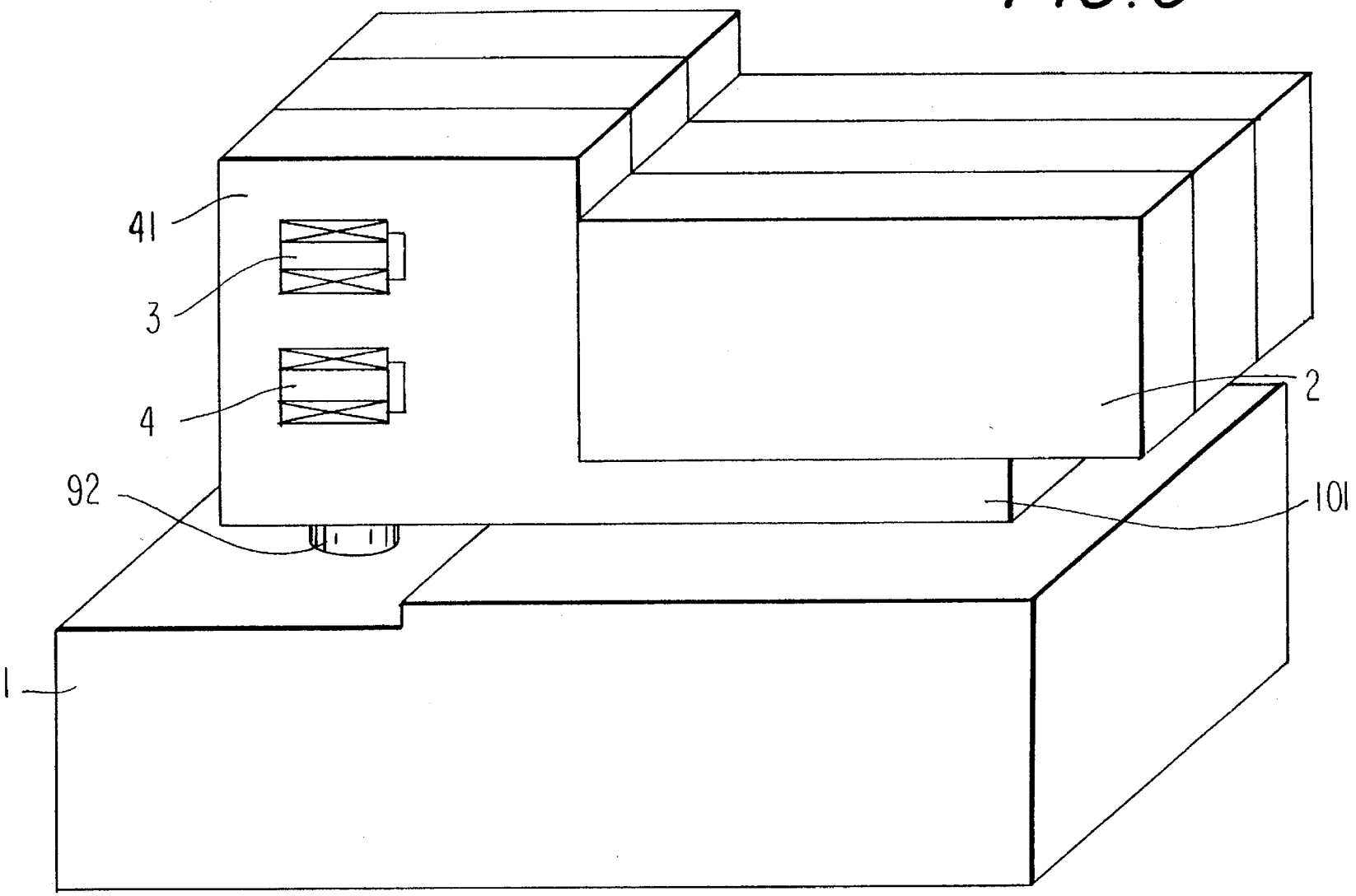
FIG. 3 shows another exemplary embodiment of the valve block in accordance with the present invention, in a perspective view.

As can be seen from FIG. 3, two pilot valves 3, 4 and two electromagnets which actuate the pilot valve are arranged one above the other in the housing 41 attached to an end face 43 of the directional valve 2.

It will be understood that each of the elements described above, or two or more together, may also find a useful application in other types of constructions differing from the types described above.

While the invention has been illustrated and described as embodied in a valve block, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A valve block, comprising a baseplate provided with connection orifices in a connection side, ducts for incoming and outgoing air, and a well; a plurality of directional valves arranged next to one another on said connection side of said baseplate with an adapted connection hole pattern; at least one pilot valve assigned to each of said directional valves; an electromagnet actuating said pilot valve; an electrical installation device arranged in said well for extending in said well and having a plug connection; an electrical connecting plug by which said electromagnet engages into said plug connection of said electrical installation device; a common housing in which said pilot valve and said electromagnet are arranged and which has a lateral attachment face bearing against an end face of an associated one of said directional valves; and a plate-shaped extension projecting laterally from said attachment face of said housing near an underside of said housing and assigned to said connecting plug, said plate-shaped extension being arranged so that said directional valve bears with its connection side against said plate-shaped extension and said baseplate bears with its connection side against said plate-shaped extension, said plate-shaped extension having a plurality of passage bores congruent with said connection orifices of said baseplate and of said directional valve.

2. A valve block as defined in claim 1, wherein said electrical installation device has contact receptacles, said baseplate having a perforation to said valve, said electrical connecting plug being formed as a plug base projecting from said underside of said housing and having projecting lugs which are contacted with said contact receptacles of said electrical installation device in said well of said baseplate, said plug base engaging in said perforation in said baseplate to said well.

3. A valve block as defined in claim 2; and further comprising a seal which seals off said plug base in said perforation of said baseplate.

4. A valve block as defined in claim 1, wherein said housing is attached to said end face of said directional valve; and further comprising a second pilot valve and a second electromagnet actuating said second pilot valve, said pilot valves and said electromagnets being arranged one behind the other in an axial direction of said directional valve in said housing attached to said end face of said directional valve.

5. A valve block as defined in claim 4, wherein said housing has a top side; and further comprising a cover which closes off said housing together with said pilot valves on said top side.

6. A valve block as defined in claim 5, wherein said cover is provided with at least one valve seat, said electromagnet having an armature with a sealing face cooperating with said at least one valve seat.

7. A valve block as defined in claim 6, wherein said cover and said housing are provided with ducts for incoming, outgoing and control air.

8. A valve block as defined in claim 1, wherein said housing is attached to said end face of said directional valve; and further comprising a second pilot valve and a second electromagnet actuating said second pilot valve, said pilot valves and said electromagnets actuating said pilot valves being arranged one above the other in said housing.

* * * * *